US005905022A

United States Patent [19]

Maskasky et al.

[11] Patent Number: 5,905,022

[45] Date of Patent: May 18, 1999

[54] CHLORIDE BROMIDE AND IODIDE NUCLEATION OF HIGH CHLORIDE (100) TABULAR GRAIN EMULSION

[75] Inventors: Joe E. Maskasky; Victor P. Scaccia, both of Rochester, N.Y.

[73] Assignee: Eastman Kodak Company, Rochester, N.Y.

[21] Appl. No.: 08/977,354

[22] Filed: Nov. 24, 1997

[51] Int. Cl.[6] ..... G03C 1/035; G03C 1/015

[52] U.S. Cl. ..... 430/569

[58] Field of Search ..... 430/567, 569

[56] References Cited

U.S. PATENT DOCUMENTS

| | | | |
|---|---|---|---|
| 5,264,337 | 11/1993 | Maskasky | 430/567 |
| 5,292,632 | 3/1994 | Maskasky | 430/567 |
| 5,320,938 | 6/1994 | House et al. | 430/567 |
| 5,413,904 | 5/1995 | Chang et al. | 430/569 |
| 5,641,620 | 6/1997 | Yamashita et al. | 430/569 |
| 5,663,041 | 9/1997 | Chang et al. | 430/569 |
| 5,665,530 | 9/1997 | Oyamada et al. | 430/567 |

FOREIGN PATENT DOCUMENTS

| | | | |
|---|---|---|---|
| 0 645 670 A1 | 3/1995 | European Pat. Off. | G03C 1/035 |
| 0 670 515 A2 | 9/1995 | European Pat. Off. | G03C 1/015 |

*Primary Examiner*—Mark F. Huff
*Attorney, Agent, or Firm*—Carl O. Thomas

[57] ABSTRACT

A process of preparing a photographically useful high chloride {100} tabular grain emulsion is disclosed. The grain characteristics of the emulsion are improved by interrupting precipitation of the grain nuclei used to prepare the emulsion by performing a halide conversion step in which a molar ratio of iodide ion to bromide ion in the range of from $1\times10^{-4}$:1 to $5\times10^{-2}$:1 is employed.

10 Claims, No Drawings

CHLORIDE BROMIDE AND IODIDE NUCLEATION OF HIGH CHLORIDE (100) TABULAR GRAIN EMULSION

FIELD OF THE INVENTION

The invention is directed to a process of preparing photographically useful silver halide emulsions. Specifically, the invention relates to an improved process for preparing high chloride {100} tabular grain emulsions.

DEFINITIONS

In referring to grains and emulsions containing two or more halides, the halides are named in order of ascending concentrations.

The term "high chloride" in referring to grains and emulsions indicates that chloride is present in a concentration of greater than 50 mole percent, based on total silver.

The term "equivalent circular diameter" or "ECD" is employed to indicate the diameter of a circle having the same projected area as a silver halide grain.

The term "aspect ratio" designates the ratio of grain ECD to grain thickness (t).

The term "tabular grain" indicates a grain having two parallel crystal faces which are clearly larger than any remaining crystal face and an aspect ratio of at least 2.

The term "tabular grain emulsion" refers to an emulsion in which tabular grains account for greater than 50 percent of total grain projected area.

The term "{100} tabular" is employed in referring to tabular grains and tabular grain emulsions containing tabular grains having {100} major faces.

The term "vAg" indicates the potential difference in volts measured during precipitation starting with a standard reference electrode (Ag/AgCl with 4 molar KCl at room temperature) in a 4 molar KCl salt bridge and a AgCl coated Ag billet indicator electrode.

*Research Disclosure* is published by Kenneth Mason Publications, Ltd., Dudley House, 12 North St., Emsworth, Hampshire P010 7DQ, England.

BACKGROUND

There are many reasons for believing high chloride {100} tabular grain emulsions, the invention of Maskasky U.S. Pat. Nos. 5,264,337 and 5,292,632, to be ideal for a variety of photographic applications. Tabular grain emulsions are well known to offer improved sharpness and an improved speed-granularity relationship. Silver chloride emulsions are recognized to be ecologically attractive and to possess the capability of rapid processing. Silver chloride grains with predominantly {100} crystal faces are recognized to have a high degree of shape stability, allowing morphologically stable {100} tabular grains to be formed.

House et al U.S. Pat. No. 5,320,938 disclosed a process of preparing high chloride {100} tabular grain emulsions that employs iodide during grain nucleation. Subsequently Chang et al U.S. Pat. No. 5,413,904 disclosed an improvement in the House et al process resulting from delaying iodide addition in the nucleation step for a short period after initial silver and chloride ion addition.

Japanese origin patent disclosures (e.g., Saitou European patent applications 0 645 670 and 0 670 515 as well as Yamashita et al U.S. Pat. No. 5,641,620 and Oyamada et al U.S. Pat. No. 5,665,530) modified the Chang et al process by purporting to substitute "halide" for iodide in grain nucleation, although no "halide" other than bromide is demonstrated. These processes for preparing high chloride {100} tabular grain emulsions rely on an AgCl/AgBr/AgCl precipitation sequence (described as creating a "halide gap") during grain nucleation to create the crystal lattice dislocations that promote {100} tabular grain growth. After grain nuclei formation further precipitation results in the growth of high chloride {100} tabular grains.

SUMMARY OF THE INVENTION

In one aspect, this invention is directed to a process of precipitating a photographically useful emulsion containing silver halide grains comprised of bromide and at least 50 mole percent chloride, based on silver, with tabular grains having {100} major faces accounting for greater than 50 percent of total grain projected area, comprised of the steps of (1) forming in a dispersing medium a population of silver halide grain nuclei accounting for from 1 to 10 percent of total silver and containing crystal lattice dislocations that promote growth of high chloride {100} tabular grains and (2) introducing into the dispersing medium silver ions and halide ions that are greater than 50 mole percent chloride ions, based on silver, to grow high chloride {100} tabular grains, wherein, step (1) is comprised of the following sequence of steps: (a) initiating precipitation of the silver halide grain nuclei in the dispersing medium, the halide consisting essentially of chloride and less than 10 mole percent bromide, based on silver, and the silver accounting for from 5 to 90 percent of total silver employed in step (1), (b) introducing iodide and bromide ions in an iodide to bromide molar ratio of from $1\times10^{-4}$:1 to $5\times10^{-2}$:1 to displace chloride from the silver halide precipitated in step (a), the bromide ions accounting for from 1 to less than 50 mole percent of the halide present in the dispersing medium, based on silver introduced in step (a), and (c) completing precipitation of the grain nuclei by introducing additional silver and halide ions, the halide consisting essentially of chloride and less than 20 mole percent bromide, based on silver introduced in this step.

It has been discovered quite unexpectedly that performing the halide conversion responsible to introducing grain nuclei crystal lattice dislocations that promote {100} tabular grain growth using a combination of bromide and iodide ions results in higher average aspect ratios and, under optimum conditions, thinner tabular grains and tabular grains that account for a higher percentage of total grain projected area. The results have been found to be dependent upon a selected ratio of iodide to bromide during the halide conversion step.

DESCRIPTION OF PREFERRED EMBODIMENTS

The invention is directed to an improved process of preparing a photographically useful high chloride {100} tabular grain emulsion.

The preparation of high chloride {100} tabular grain emulsions is made up of at least two stages. The first stage forms in a dispersing medium within a reaction vessel a population of grain nuclei containing crystal lattice dislocations that promote growth of high chloride {100} tabular grains. In the second stage the grain nuclei are grown to form high chloride {100} tabular grains.

The process of the invention in one form can be viewed as a modification of the grain nuclei formation stage of conventional processes for preparing high chloride {100} tabular grain emulsions. Except for the modification of grain nuclei formation, taught below, the processes of the invention can take the form of conventional processes that introduce bromide or iodide in forming grain nuclei capable of promoting the growth of high chloride {100} tabular grains, such as those disclosed by

| | |
|---|---|
| Maskasky | U.S. Pat. No. 5,275,930; |
| House et al | U.S. Pat. No. 5,320,938; |
| Brust et al | U.S. Pat. No. 5,314,798; |
| Maskasky | U.S. Pat. No. 5,399,477; |
| Chang et al | U.S. Pat. No. 5,413,904; |
| Olm et al | U.S. Pat. No. 5,457,021; |
| Maskasky | U.S. Pat. No. 5,604,085; |
| Yamashita et al | U.S. Pat. No. 5,641,620; |
| Chang et al | U.S. Pat. No. 5,663,041; |
| Oyamada et al | U.S. Pat. No. 5,665,530; |

the disclosures of which are here incorporated by reference.

It has been discovered quite unexpectedly that grain improvements can be realized by employing limited amounts of iodide ion in combination with bromide ion in forming the crystal lattice dislocations in grain nuclei responsible for promoting the growth of high chloride {100} tabular grains. Grain improvements are realized when the molar ratio of $I^-$:Br is maintained in the range of from $1\times10^{-4}$:1 to $5\times10^{-2}$:1 and preferably in the range of from $5\times10^{-4}$:1 to $1\times10^{-2}$:1.

The process of the present invention in one form can be accomplished by merely adding iodide, in the proportion indicated, to the bromide used to form the halide gap in the grain nuclei of Yamashita et al U.S. Pat. No. 5,641,620 or Oyamada et al U.S. Pat. No. 5,665,530, cited and incorporated by reference above. No modification of the high chloride {100} tabular grain growth stage of precipitation is required.

In an alternative form, the process of the invention can be practiced by replacing the iodide employed by Chang et al U.S. Pat. Nos. 5,413,904 and 5,663,041, cited and incorporated by reference above, to form crystal lattice dislocations in the grain nuclei with bromide and iodide in the molar ratio of $I^-$:$Br^-$ noted above. No modification of the high chloride {100} tabular grain growth stage of precipitation is required.

In a preferred form of the invention the grain nuclei formation stage of precipitation is comprised of three steps. In the first step (a) precipitation of silver halide grain nuclei is initiated in a dispersing medium within a reaction vessel. The halide chosen consists essentially of chloride and less than 10 mole percent bromide. The initially precipitated silver halide is preferably silver bromochloride or, most preferably, silver chloride. In step (a) from 5 to 90 (preferably 10 to 50) percent of total silver precipitated in forming the grain nuclei is introduced.

Upon completion of step (a), in other words after silver and halide ion addition has been completed, a second step (b) is undertaken in which iodide and bromide ions in the molar ratio range noted above are made available in the dispersing medium to displace chloride ions from the silver halide precipitated in step (a). The amount of bromide ion introduced amounts to from 1 (preferably 5) to less than 50 (preferably 25) mole percent of halide in the dispersing medium, based on silver introduced in step (a). Since the solubility product constant (Ksp) of silver iodide is approximately 6 orders of magnitude less than that of silver chloride and the Ksp of silver bromide is approximately 3 orders of magnitude less than that of silver chloride, the bromide and iodide ions displace chloride ions in the silver halide precipitated in step (a) and are for all practical purposes absent from the dispersing medium at the conclusion of step (b).

In a third step (c) of forming the grain nuclei the remainder of the silver ion used to form the grain nuclei is introduced along with halide ion. The halide ion consists essentially of chloride and less than 20 (preferably less than 10) mole percent bromide, based on silver introduced in this step. The silver introduced in this step accounts for from 10 to 95 (preferably 50 to 90) percent of the total silver used to form the grain nuclei.

Except as noted, grain nuclei formation can conform to the conventional practices disclosed in patents cited and incorporated by reference above. It is preferred that grain nuclei formation occur in a reaction vessel containing an aqueous dispersing medium maintained at a temperature in the range of from 35 to 50° C. pH is preferably adjusted to the range of from 3.5 to 7 (most preferably from 3.5 to 5.0), although a pH of down to 2.0 can be employed when a gelatino-peptizer is employed that contains less than 4 micromoles per gram of methionine. pH adjustment can be accomplished by employing a base, such as an alkali hydroxide, or a mineral acid, such as $HNO_3$. If desired, a buffering agent can be introduced to increase the ease of maintaining the emulsion within the indicated pH range.

The vAg of the dispersing medium used in forming the grain nuclei emulsion preferably is adjusted to lie within the range of form 105 to 260 mV, most preferably 140 to 200 mV. vAg is regulated by adding either silver ion (e.g., silver nitrate in solution) or halide ion (e.g., alkali halide in solution).

The dispersing medium also contains a conventional peptizer, such as a gelatino-peptizer. Various conventional peptizers, including gelatino-peptizers, are illustrated by *Research Disclosure,* Vol. 38957, Sept. 1996, Item 38957, Section II. Vehicles, vehicle extenders, vehicle-like addenda and vehicle related addenda, A. Gelatin and hydrophilic colloid peptizers, particularly paragraphs (1) to (3). A more extensive discussion of gelatin and its properties is provided by James *The Theory of the Photographic Process,* 4th Ed., Macmillan, New York, 1977, Chapter 2, Gelatin. Any of the varied forms of peptizers disclosed by the patents cited and incorporated by reference above can be employed.

It is specifically contemplated to employ gelatino-peptizers that contain natural levels of methionine, typically between 40 and 60 micromoles per gram. The presence during grain nucleation of gelatino-peptizer that contains at least 40 micromoles of methionine per gram has been observed to result in high chloride {100 } tabular grains accounting for a higher proportion of total grain projected area. Preferred concentrations of gelatino-peptizer that contains at least 40 micromoles of methionine per gram during the grain nuclei formation step are in the range of from 0.5 to 5.0 grams per mole of silver present at the completion of the grain growth step.

Alternatively gelatino-peptizer can be employed that has been treated with an oxidizing agent (e.g., hydrogen peroxide) to reduce methionine levels. It is specifically contemplated to employ gelatino-peptizer that contains less than 10 micromoles of methionine per gram. It has been discovered quite unexpectedly that the selection of gelatino-peptizer from which methionine has been substantially eliminated (reduced to less than 4 micromole per gram) allows more rapid completion of the grain ripening step, discussed below. This effect is not, however, limited to employing gelatino-peptizer containing less than 4 micromole of methionine per gram during formation of the grain nuclei, but can also be realized when low methionine gelatino-peptizer is added immediately prior to or during grain growth. Preferred concentrations of gelatino-peptizer that contains less than 4 micromoles of methionine per gram during the grain nuclei formation step are in the range of from 1.0 to 60.0 grams per mole of silver present at the completion of the grain growth step.

To achieve the highest possible percent of total grain projected area accounted for by tabular grains while also achieving a rapid rate of grain ripening, it is preferred to employ a gelatino-peptizer containing at least 40 micromoles methionine per gram during formation of the grain nuclei and subsequently adding gelatino-peptizer that contains less than 4 micromoles methionine per gram immediately prior to or during grain growth.

The grain nuclei, once formed according to the teachings of this invention can be used as hosts for the growth of high chloride {100} tabular grains following conventional grain growth practices, such as those disclosed in the patents cited and incorporated by reference above.

A preferred growth procedure is that disclosed in Maskasky et al U.S. Ser. No. 08/976,321, filed Nov. 21, 1991, commonly assigned, titled A PROCESS OF PREPARING HIGH CHLORIDE {100} TABULAR GRAIN EMULSIONS. With the grain nuclei emulsion in the temperature range of from 35 to 50° C., pH in the range of from 3.5 to 7.0, vAg in the range of from 105 to 260 mV, preferably 140 to 200 mV, and gelatino-peptizer as indicated above, the growth of high chloride {100} tabular grains is initiated by a renucleation step, wherein the balance of the silver and halide ion to be incorporated in the photographically useful emulsion is introduced. The silver ion introduced accounts for from 90 to 99 (preferably 92 to 97) percent of total silver in the photographically useful emulsion. Halide ion is introduced as required to satisfy the vAg range limits noted above.

Preferably silver ion is introduced in the renucleation step in the form of any convenient conventional soluble salt solution—e.g., a silver nitrate salt solution. Similarly, the halide ion is introduced in the form of any convenient conventional soluble salt solution—e.g., an alkali halide salt solution). Alternatively the silver and halide ions can be introduced in the form of a fine grain emulsion. For example, when chloride is the sole halide in the fine grains, these grains can be easily ripened out in grain sizes of up to 0.20 μm mean ECD. Fine bromochloride grains containing just greater than 50 mole percent chloride, based on silver, can be easily ripened out in grain sizes of up to 0.10 μm mean ECD.

One of the surprising advantages that has been realized is that more concentrated emulsions can be prepared by silver and halide ion addition according to the invention. The concentrations of the silver and halide ions introduced in the addition are regulated to create a total volume of emulsion in the range of from 0.7 to 2.0 liters per silver mole. The advantage of limiting the volume of the emulsion in relation to the silver ion is that the emulsion generating capacity of the reaction vessel is increased.

The halide introduced during the renucleation step is chosen so that chloride accounts for greater than 50 mole percent, based on silver, of total halide in the reaction vessel. Since only very small concentrations of bromide and iodide are required for grain nucleation, it is appreciated that the chloride concentration can exceed 99 mole percent, based on silver. The balance of the halide not accounted for by chloride, if any, is preferably bromide. It is preferred to avoid the introduction of iodide ion during the renucleation step, although significant concentrations of iodide can be added later in the subsequent ripening step, if desired.

More gelatino-peptizer can be added during the renucleation step, if necessary. The concentration of gelatino-peptizer employed to peptize the emulsion being formed through the growth step ranges from 10 to 60 grams per mole of silver present at the conclusion of the renucleation step. Thus, it is apparent that, when the gelatin containing less than 4 micromoles per gram of methionine is employed during grain nuclei formation, gelatin concentrations can be employed that allow grain renucleation to be completed without further gelatino-peptizer addition. As previously indicated, when gelatino-peptizer containing at least 40 micromoles of methionine per gram is employed during formation of the grain nuclei, it is advantageous to incorporate additional gelatino-peptizer containing less than 4 micromoles of methionine per gram during the renucleation step to reduce the time required for ripening. Both forming grain nuclei and performing the renucleation step in the presence gelatino-peptizer that contains less than 4 micromoles methionine per gram is particularly advantageous in that rapid rates of ripening can be realized without further gelatino-peptizer addition, thereby simplifying the preparation process.

The addition of halide ion and the balance of the silver ion during the renucleation step creates a second grain population within the dispersing medium. Growth of the high chloride {100} tabular grains is driven by temperature as the ripening out of the second grain population occurs, thereby redepositing the silver halide from the second grain population onto the grain nuclei that contain crystal lattice dislocations favorable for {100} tabular grain growth. Ideally the ripening out process is terminated as the last remaining grains of the second grain population are ripened out. If ripening is continued beyond this point, the comers of the high chloride {100} tabular grains become progressively more rounded and the tabular grains increase in thickness. Corner rounding is common in high chloride {100} tabular grain emulsions and is not objectionable in the process. Hence the termination of ripening is dictated by the maximum thickness of the tabular grains that can be tolerated for the intended photographic application. It is preferred as a practical matter to discontinue grain ripening just after depleting the second grain population.

To facilitate ripening of the second grain population and hence growth of the high chloride {100} tabular grains, the temperature of the dispersing medium is increased following the addition step. A temperature in the range of from 60 to 95° C. (preferably 65 to 85° C.) is contemplated. The purpose of raising the temperature is to accelerate the rate of ripening. At temperatures below 60° C. the rate of ripening is unacceptably slow.

It has been observed that, in addition to raising the temperature to accelerate ripening, maintaining a vAg in the range of from 105 to 140 mV increases the rate of ripening, with the rate of ripening increasing as vAg decreases. Thus, employing a gelatino-peptizer containing less than 4 micromoles of methionine per gram in a dispersing medium maintained at a vAg of from 105 to 140 mV and at an elevated temperature, as noted above, results in the most accelerated rates of ripening.

Whereas Yamashita et al and Oyamada et al, cited above, introduce silver and halide ion consumed during grain growth following temperature elevation to drive ripening, it has been discovered quite surprisingly that superior high chloride {100} tabular grain characteristics are realized when silver ion addition is completed prior to elevating temperature to drive grain ripening.

It is, in fact, preferred to introduce all of the silver ion into the dispersing medium before any substantial growth of the grain nuclei can occur. Thus, rapid silver and halide ion additions preceding raising the temperature of the dispersing medium are preferred. So called "dump" additions are preferred—that is, the rate of addition is the maximum that the operating equipment will permit and is not intentionally limited. Completion of silver ion addition in less than 15 minutes is contemplated.

The high chloride {100} tabular grain emulsions obtained at the conclusion of the ripening step contain greater than 50 mole percent chloride, preferably at least 70 mole chloride, and optimally at least 90 mole percent chloride, based on silver. Bromide preferably accounts for the balance of the halide.

Although iodide ion is limited in the earlier stages of emulsion preparation, as indicated above, it is possible to incorporate significant iodide concentrations in the latter stages of ripening. Alternatively, after the ripening process described above is completed without iodide addition, iodide can be incorporated in a subsequent conventional step of grain growth involving iodide ion addition and further ripening or by the introduction of additional silver and halide ion, including iodide ion. Iodide levels are preferably limited to less than 10 (most preferably less than 5) mole percent, based on silver. Since iodide is known to limit processing rates, one of generally sought advantages of employing high chloride emulsions, it is preferred that iodide in the grains be limited. For example, the grains are preferably free of iodide concentrations above the low levels shown to be useful during grain nuclei formation.

It is recognized in the art that introducing crystal lattice dislocations at the edge of tabular grains increases their speed without increasing their granularity. Tabular grains emulsions that contain peripheral crystal lattice dislocations are disclosed by Wilgus et al U.S. Pat. No. 4,434,226, Kofron et al U.S.

U.S. Pat. No. 4,439,520, Solberg et al U.S. Pat. No. 4,433,048, Ikeda et al U.S. Pat. No. 4,806,461, Takahara et al U.S. Pat. No. 5,068,173, Haga et al U.S. Pat. No. 5,472,836, Suga et al U.S. Pat. No. 5,550,012, and Maruyama et al U.S. Pat. No. 5,550,014, the disclosures of which are here incorporated by reference. The addition of iodide ion at the late stages of ripening, preferably when less than 20 (preferably <10) percent but at least 0.5 (preferably 1.0) percent of total silver remains in the second grain population, is capable of increasing the speed of the emulsions obtained at the conclusion of ripening. It is contemplated to release iodide ion in the dispersing medium during ripening by adding elemental iodine, as disclosed in Maskasky et al U.S. Ser. No. 08,955,867, filed Oct. 21, 1997, commonly assigned, titled HIGH CHLORIDE TABULAR GRAIN EMULSIONS AND PROCESSES FOR THEIR PREPARATION. Alternatively, iodide ion can be released in the dispersing medium during ripening by adding an organic iodide ion source compound with a maximum second order reaction rate constant of less than $1\times10^3$ mole$^{-1}$ sec$^{-1}$, as disclosed in Maskasky et al U.S. Ser. No. 08/961,962, filed Oct. 31, 1997, commonly assigned titled A PROCESS OF PREPARING HIGH CHLORIDE {100} TABULAR GRAIN EMULSIONS. Specific illustrations of organic iodide ion source compounds are provided by Suga et al and Takahara et al.

The high chloride {100} tabular grain emulsions produced by the process of the invention can satisfy known grain characteristics, such as mean ECD, average tabular grain thicknesses, average tabular grain aspect ratios and percent total grain projected area accounted for by {100} tabular grains. Typically the mean ECD of the photographically useful product emulsions is less than about 5 $\mu$m and most typically in the range of from about 0.3 to 3.0 $\mu$M. The tabular grains are contemplated to have thicknesses less than 0.3 $\mu$m and preferably less than 0.2 $\mu$m.

It is generally preferred that the {100} tabular grains account for the highest attainable percent of total grain projected area. It is preferred that the {100} tabular grains at the conclusion of the ripening step account for at least 70 percent and optimally at least 90 percent of total grain projected area Once formed, the high chloride {100} tabular grain emulsions can be sensitized, combined with conventional photographic addenda, and coated in any conventional manner, as is further illustrated by the following patents disclosing high chloride tabular grain emulsions and their use, here incorporated by reference:

| | |
|---|---|
| Maskasky | U.S. Pat. No. 5,264,337; |
| Maskasky | U.S. Pat. No. 5,275,930; |
| Maskasky | U.S. Pat. No. 5,292,632; |
| Brust et al | U.S. Pat. No. 5,314,798; |
| House et al | U.S. Pat. No. 5,320,938; |
| Szajewski et al | U.S. Pat. No. 5,356,764; |
| Oikawa | U.S. Pat. No. 5,654,133; |
| Chang et al | U.S. Pat. No. 5,413,904; |
| Budz et al | U.S. Pat. No. 5,451,490; |
| Olm et al | U.S. Pat. No. 5,457,021; |
| Brennecke | U.S. Pat. No. 5,498,518; |
| Yamashita | U.S. Pat. No. 5,565,315; |
| Saitou et al | U.S. Pat. No. 5,587,281; |
| Oyamada | U.S. Pat. No. 5,593,821; |
| Yamashita et al | U.S. Pat. No. 5,641,620; |
| Yamashita et al | U.S. Pat. No. 5,652,088; |
| Saitou et al | U.S. Pat. No. 5,652,089; |
| Oikawa | U.S. Pat. No. 5,654,133; and |
| Chang et al | U.S. Pat. No. 5,663,041. |

Generally preparing the emulsions for use following precipitation begins with emulsion washing. This is in turn followed by chemical and spectral sensitization. Antifoggant and stabilizer addition is usually also undertaken. The emulsions are also combined with additional levels of vehicle before coating. Hardener is added to one or more vehicle layers just before coating. The emulsions are contemplated for use in both black-and-white (silver image forming) and color (dye image forming) photographic elements. The emulsions can be incorporated in radiographic and black-and-white photographic elements. The emulsions can also be incorporated in color print, color negative or color reversal elements. The following paragraphs of *Research Disclosure,* Vol. 389, September 1996, Item 38957, illustrate conventional photographic features compatible with the emulsions of the invention:

I. Emulsion grains and their preparation E. Blends, layers and performance categories II. Vehicles, vehicle extenders, vehicle-like addenda and vehicle related addenda III. Emulsion washing IV. Chemical sensitization V. Spectral sensitization and desensitization VII. Antifoggants and stabilizers IX. Coating physical property modifying addenda X. Dye image formers and modifiers XI. Layer arrangements XV. Supports XVIII. Chemical development systems

EXAMPLES

The invention can be better appreciated by reference to the following specific examples. References to "high methionine" gelatin indicate a methionine content of 58 micromoles per gram. References to "low methionine" gelatin indicate that the high methionine gelatin was treated with hydrogen peroxide to reduce its methionine content to 0.1 micromole per gram.

Comparison Example 1

Example 1 of Saitou EPO 0 670 515 A2

This comparison example was prepared following the procedure given in Example 1 of Saitou EPO 0 670 515 A2, except that, to accommodate the equipment available, the make was scaled up by a factor of 2 (i.e., the emulsion make was doubled in volume).

A gelatin solution (comprising 2.4 L of water, 44 g of deionized alkaline treated high methionine gelatin and 1.0 g of NaCl, and having a pH of 4.0 adjusted with $HNO_3$) was placed in a reaction vessel. To the solution while stirring at 30° C., 1 L of Ag-1 solution (containing 200 g of $AgNO_3$, 2.0 mL of 1N solution of $HNO_3$, and 6 g of a low molecular weight gelatin) and X-1 solution (containing 70 g NaCl and 6.0 g of low molecular weight gelatin in 1 L) were simultaneously added at the same feed rate of 100 mL per min for 30 sec to form silver chloride nuclei. (Low molecular weight gelatin was prepared by heating for 1 hr at 70° C. a 10 wt. % solution of the high methionine gelatin at a pH of 2.0, adjusted with $HNO_3$. The gel solution was then adjusted to a pH of 5.6 at 40° C.) To the nuclei, X-2 solution (containing 2.8 g of KBr and 1.6 g of the low molecular weight gelatin in 200 mL) was added with good mixing. After the mixture was heated to 40° C., the Ag-1 solution and the X-1 solution were simultaneously added at the feed rate of 100 mL per min for 90 sec. After the mixture was adjusted to pH 5.0 using 1 N NaOH solution, an aqueous solution of NaCl (containing 4.2 g NaCl in 100 mL water) was added to the mixture. The resulting mixture was heated to 70° C. for 15 min. After the emulsion was ripened for 15 min, the Ag-1 solution and the X-1 solution were simultaneously added to the emulsion at the initial feed rate of 20 mL per min and at pCl of 1.45 for 47 min while the feed rate was linearly accelerated at 0.2 mL per min. The emulsion was ripened for 8 min.

A 2 mL sample of the emulsion (1A) was then removed. The emulsion had 70% of the total grain projected area as {100} tabular grains that had an average equivalent circular diameter of 1.2 μm, an average thickness of 0.22 μm, and an average aspect ratio of 5.5.

The Ag-1 solution and X-3 solution (containing 4.2 g of KBr and 5.0 g NaCl in 100 mL) were added to the emulsion at the feed rate of 100 mL for 1 min with good mixing. Further, the Ag-1 solution and X-4 solution (containing 8.4 g of KBr and 2.9 g of NaCl in 100 mL) were added at the feed rate of 80 mL per min for 1 min with good mixing. Furthermore, X-5 solution (containing 20 g of KI in 100 mL) was added at the feed rate of 80 mL per min for 12 sec. After the emulsion was ripened for 3 min, the emulsion was cooled to 40° C.

The resulting emulsion (1B) had 70% of the total grain projected area as {100} tabular grains that had an average ECD of 1.2 μm, an average thickness of 0.24 μm, and an average aspect ratio of 5.0.

The results are summarized in Table I.

Example 2

Molar Ratio of $I^-$:$Br^-$ $8\times10^{-3}$:1 at Nucleation

A vigorously stirred reaction vessel containing 2400 mL of a solution which contained 144 g of deionized low methionine bone gelatin and 0.014 M in NaCl was adjusted to pH 3.0 at 40° C. To this solution at 40° C. were added simultaneously for 15 sec, 1.25 M $AgNO_3$ solution and 1.27 M NaCl solution at a rate of 120 mL per min. The mixture was stirred for 2 min then 50 mL of a solution 0.10 M in NaBr and $7.8\times10^{-4}$ M in KI was added at a rate of 100 mL per min to nucleate the tabular grains, followed by a 2 min hold. Then the $AgNO_3$ and NaCl solutions were simultaneously added at 120 mL per min for 1 min. After a 2 min hold, the pH was adjusted to 5.50 at 40° C. with dilute NaOH solution.

After a 2 minute hold, 4.0 M $AgNO_3$ solution was added at 120 mL per min (~0.2 mole Ag per min per L of emulsion) at 40° C. while maintaining a pH of 5.50 and a vAg of 155 mV by the concurrent addition of 4.0 M NaCl solution. When 1 L of 4 M $AgNO_3$ solution had been added, the additions were stopped. The mixture was heated to 75° C. at a rate of 1.7° C. per min and the vAg was maintained at 155 mV by the addition of NaCl solution and the pH at 5.5. The emulsion was stirred at 75° C. for 150 min, the minimum time needed to ripen away the fine grain population.

The resulting high-chloride tabular grain emulsion was comprised of tabular grains having {100} major faces which made up 94% of the projected area of the total grain population. This tabular grain population had an average ECD of 3.4 μm and an average thickness of 0.11 μm. The average aspect ratio was 31. The yield per unit volume of unwashed emulsion was 1.1 liters of emulsion per mole Ag.

The results are summarized in Table I.

Comparison Example 3

Bromide, but no iodide in nucleation

This emulsion was made similarly to that of Example 2, except that the solution used to nucleate the tabular grains was 0.1 M NaBr (no KI was added). The final emulsion was stirred at 75° C. for 95 min, the minimum time needed to ripen away the fine grain population.

The resulting high-chloride tabular grain emulsion was comprised of tabular grains having {100} major faces which made up 90% of the projected area of the total grain population. This tabular grain population had an average equivalent circular diameter of 2.1 μm and an average thickness of 0.13 μm. The average aspect ratio was 16. The yield per unit volume of unwashed emulsion was 1.1 liters of emulsion per mole Ag.

Comparison Iodide, but no bromide in nucleation Example 4

This emulsion was made similarly to that of Example 2, except that the solution used to nucleate the tabular grains was $7.8\times10^{-4}$ M KI (no NaBr was added). The final emulsion was stirred at 75° C. for 300 min and some fine grains remained.

The resulting high-chloride emulsion was not a tabular grain emulsion. Only 35% of the projected area of the total grain population was accounted for by tabular grains having {100} major faces.

Comparison Example 5

Molar Ratio of $I^-$:$Br^-$ $8\times10^{-2}$:1 at Nucleation

This emulsion was made similarly to that of Example 2, except that the solution used to nucleate the tabular grains was 0.10 M in NaBr and $7.8\times10^{-3}$ M in KI. The final emulsion was stirred at 75° C. for 105 min, the minimum time needed to ripen away the fine grain population.

The resulting high chloride tabular grain emulsion was comprised of tabular grains having {100} major faces that made up only 60% of the projected area of the total grain population. This tabular grain population had an average ECD of 2.0 μm and an average thickness of 0.13 μm. The average aspect ratio was 15.

The results are summarized in Table I.

Example 6

Molar Ratio of $I^-:Br^-8\times10^{-4}$:1 at Nucleation

This emulsion was made similarly to that of Example 2, except that the solution used to nucleate the tabular grains was 0.10 M in NaBr and $7.8\times10^{-5}$ M in KI. The final emulsion was stirred at 75° C. for 188 min, the minimum time needed to ripen away the fine grain population.

The resulting high-chloride tabular grain emulsion was comprised of tabular grains having {100} major faces that made up 90% of the projected area of the total grain population. This tabular grain population had an average equivalent circular diameter of 2.5 μm and an average thickness of 0.13 μm. The average aspect ratio was 19. The yield per unit volume of unwashed emulsion was 1.1 liters of emulsion per mole Ag.

The results are summarized in Table I.

TABLE I

| Example | $I^-:Br^-$ (molar ratio) | Yield (liters of emulsion per mole Ag) | Average ECD (μm) | Average thickness (μm) | Average aspect ratio | Tabular Grain % of Total Projected Area |
|---|---|---|---|---|---|---|
| Comp.Ex. 1A | No $I^-$ | 3.3 | 1.2 | 0.22 | 5.5 | 70 |
| Comp.Ex. 1B | No $I^-$ | 3.1 | 1.2 | 0.24 | 5.0 | 70 |
| Ex. 2 | $8\times10^{-3}$ | 1.1 | 3.4 | 0.11 | 31 | 94 |
| Comp.Ex. 3 | No $I^-$ | 1.1 | 2.1 | 0.13 | 16 | 90 |
| Comp.Ex. 4 | No $Br^-$ | | non-tabular | | | 35 |
| Comp.Ex. 5 | $8\times10^{-2}$ | 1.1 | 2.0 | 0.13 | 15 | 60 |
| Ex. 6 | $8\times10^{-4}$ | 1.1 | 2.5 | 0.13 | 19 | 90 |

From Table I it is apparent that the absence of bromide ion in nucleation resulted in an emulsion that contained some tabular grains, but was not a tabular grain emulsion (Comp. Ex. 4). When bromide ion was employed during nucleation without iodide ion, as is currently practiced in the art (Comp. Ex. 1A, 1B and 3), the emulsions exhibited lower average ECD's, greater average tabular grain thicknesses, and lower average aspect ratios than the emulsions prepared by the process of the invention. When the molar ratio of iodide to bromide was increased above $5\times10^{-2}$ (Comp. Ex. 5), the average ECD of the emulsion decreased and the percent of total grain projected area accounted for by tabular grains decreased.

The emulsions prepared by the process of the invention, specifically with the molar ratio of iodide ion to bromide ion required by the invention, exhibited superior tabular grain emulsion properties. The tabular grains accounted for a high percentage of total grain projected area. The average grain ECD and the average aspect ratio of the tabular grains was increased.

The preferred embodiment of the invention, Ex. 2, produced a tabular grain emulsion that exhibited a higher average ECD, a lower average tabular grain thickness, and a higher average aspect ratio. In addition tabular grains accounted for a higher percentage of total grain projected area.

The invention has been described in detail with particular reference to preferred embodiments thereof, but it will be understood that variations and modifications can be effected within the spirit and scope of the invention.

What is claimed is:

1. A process of precipitating a photographically useful emulsion containing silver halide grains comprised of bromide and at least 50 mole percent chloride, based on silver, with tabular grains having {100} major faces accounting for greater than 50 percent of total grain projected area, comprised of the steps of (1) forming in a dispersing medium a population of silver halide grain nuclei accounting for from 1 to 10 percent of total silver and containing crystal lattice dislocations that promote growth of high chloride {100 } tabular grains and (2) introducing into the dispersing medium silver ions and halide ions that are greater than 50 mole percent chloride ions, based on silver, to grow high chloride {100} tabular grains, wherein, step (1) is comprised of the following sequence of steps:

(a) initiating precipitation of the silver halide grain nuclei in the dispersing medium, the halide consisting essentially of chloride and less than 10 mole percent bromide, based on silver, and the silver accounting for from 5 to 90 percent of total silver employed in step (1), (b) introducing iodide and bromide ions in an iodide to bromide molar ratio of from $1\times10^{-4}$:1 to $5\times10^{-2}$:1 to displace chloride from the silver halide precipitated in step (a), the bromide ions accounting for from 1 to less than 50 mole percent of the halide present in the dispersing medium, based on silver introduced in step (a), and (c) completing precipitation of the grain nuclei by introducing additional silver and halide ions, the halide consisting essentially of chloride and less than 20 mole bromide, based on silver introduced in this step.

2. A process according to claim 1 wherein the molar ratio of iodide ions to bromide ions added in step (b) is in the range of from $5\times10^{-4}$:1 to $1\times10^{-2}$:1.

3. A process according to claim 1 wherein the grain nuclei account from 3 to 8 percent of total silver added during steps (1) and (2).

4. A process according to claim 1 wherein the silver added in step (a) accounts for from 10 to 50 percent of total silver added in step (1).

5. A process according to claim 1 wherein the bromide added in step (b) accounts for from 5 to 25 mole percent of the halide, based on silver added in step (a).

6. A process according to claim 1 wherein chloride is added as the sole halide in steps (a), (c) and (2).

7. A process according to claim 1 wherein pH is maintained in the range of from 2.0 to 7.0 during step (1).

8. A process according to claim 1 wherein a gelatino-peptizer containing less than 4 micromoles of methionine per gram is present in step (1), the gelatino-peptizer being present in a concentration of from 1 to 60 grams per mole of silver present at the conclusion of step (2).

9. A process according to claim 8 wherein the gelatino-peptizer is present in step (1) in a concentration of at least 10 grams per mole of silver present at the conclusion of step (2) and no additional gelatino-peptizer is added in step (2).

10. A process according to claim 1 wherein a gelatino-peptizer containing at least 40 micromoles of methionine per gram is present in step (1), the gelatino-peptizer being present in a concentration of from 0.5 to 5 grams per mole of silver present at the conclusion of step (2).

* * * * *